US005448820A

United States Patent [19]

LeBlanc

[11] Patent Number: 5,448,820

[45] Date of Patent: Sep. 12, 1995

[54] METHOD OF MANUFACTURING FLANGED SHAFTS

[75] Inventor: Timothy A. LeBlanc, Livonia, Mich.

[73] Assignee: Machine Tool & Gear, Inc., Fenton, Mich.

[21] Appl. No.: 279,520

[22] Filed: Jul. 25, 1994

[51] Int. Cl.[6] ..... B23P 13/04

[52] U.S. Cl. ..... 29/558; 82/1.11

[58] Field of Search ..... 29/406, 557, 558; 82/1.11; 408/1 R

[56] References Cited

U.S. PATENT DOCUMENTS 4,768,369 9/1988 Johnson et al. ..... 29/558

*Primary Examiner*—David P. Bryant

*Attorney, Agent, or Firm*—Brooks & Kushman

[57] ABSTRACT

A method for manufacturing a flanged shaft from a forging having a shaft and a flange having an inboard side and an outboard side using a first lathe and a second lathe. The method comprises chucking the forging in the first lathe such that at least the outboard side of the forging may be worked on and finishing at least the outboard side of the flange. The forging is then removed from the first lathe and chucked in a second lathe while referencing the forging off the outboard side of the flange such that the remainder of the forging may be worked on. The remainder of the forging is then finished into a flanged shaft.

34 Claims, 4 Drawing Sheets

METHOD OF MANUFACTURING FLANGED SHAFTS

TECHNICAL FIELD

This invention relates to an improved method for manufacturing integral shafts having a flange on one end, referred to as flanged shafts, such as rear axle shafts for rear wheel drive vehicles or output shafts for transmissions.

BACKGROUND ART

Integral shafts having a flange on one end, which will be referred to as flanged shafts, are used in a variety of mechanical applications. For example, and more specifically, such flanged shafts may comprise the rear axles of rear wheel drive automobiles or the output shafts used in vehicle transmissions.

Flanged shafts are typically manufactured from raw forgings, typically supplied by forging houses or companies, such as the forging 1 illustrated in FIG. 1. Such forgings are typically created by upsetting one end of a shaft 2 to create a flange 3. The shaft 2 has a shaft end 4 and a center axis 5. The flange 3 has two sides, an inboard side 6*a* and an outboard side 6*b*. The flange 3 also has a perimeter 7.

For decades, since at least the advent of the rear wheel drive automobile, flanged shafts have been manufactured from such raw forgings using the same three step method.

First, the forging is placed in a center drill and milling machine. More specifically, the unfinished shaft 2 of the raw forging is placed within a centering vise, thereby positioning the center axis 5 of the forging 1 radially in the center drill and milling machine. The forging 1 is positioned axially within the center drill and milling machine by butting the unfinished inboard side 6*a* or the unfinished outboard side 6*b* of the flange 3 against a flange stop of the machine.

At that point, the centering vise is locked onto the shaft 2 and the center drill and milling machine is operated. A milling tool mills the shaft end 4 of the forging 1 to a desired length; a flange center drill drills a flange bore in the outboard side 6*b* of the flange 3; and a shaft center drill drills a shaft bore in the shaft end 4 of the shaft 2. Because the forging 1 is positioned axially based on butting an unfinished flange side 6*a* or 6*b* against a flange stop, the axial depth of the central drilled flange and shaft bores are dependent on the surface configuration of the unfinished flange side 6*a* or 6*b* being used as a reference point. Likewise, because the forging 1 is positioned radially based on locking the centering vise against the unfinished shaft 2, the radial position of the center drilled flange and shaft bores are dependent on the surface configuration of the unfinished shaft 2. The radial and axial position of the center drilled bores are very important because they are used as reference points in the traditional method during the following steps in order to orient the forging 1 both axially and radially.

To complete the first step, the centering vise is loosened and the forging 1 is removed from the center drill and milling machine.

In the second step, the forging 1 is machined between centers on a lathe. First and second centers are advanced into the center drilled holes on the shaft end 4 and the outboard side 6*b* of the forging 1, respectively, to position the forging 1 both axially and radially relative to the lathe. A chuck, such as a 3-jaw or 4-jaw chuck, is used to clamp the forging 1, typically on the flange 3 or the shaft 2. After turning the forging 1 by rotating the forging 1 at a high speed and applying a cutting tool to the surfaces desired to be finished, the forging 1 is then released from the chuck and the first and second centers.

In the third step, the forging 1 is turned end for end and machined again between the centers on a lathe. First and second centers are again locked into the center drilled holes on the outboard side 6*b* and the shaft end 4 of the forging 1, respectively, to position the forging 1 both axially and radially. The forging 1 is again clamped in a chuck and turned by rotating the forging 1 at high speed. A cutting tool is applied to the surfaces desired to be finished which could not be finished by the cutting tool in the second step. The forging 1 is then released from the chuck and the centers and the resulting flanged shaft can proceed through further finishing and heat treatment procedures if desired.

The disadvantages inherent in this traditional method are several. First, and most obviously, the center drilled bores drilled in the first step, which establish the reference points for positioning the forging 1 in subsequent steps, are themselves referenced from the raw surface of the unfinished forging. As a result, surface and geometrical deviations in the raw forging as supplied will result in a defective flanged shaft which must be scrapped. For example, if the flange 3 of the forging 1 is not perpendicular to the center axis 5, or if the flange is thicker than it should be, the butting of the inboard side 6*a* or the outboard side 6*b* of the flange 3 against the flange stop of the center drill and milling machine will not position the forging 1 in the correct axial position. As a result, the shaft end 4 will be milled to the wrong dimension and, more importantly, the center drilled flange and shaft bores used as reference points in the subsequent steps will be either too shallow or too deep. Therefore, the forging 1 will not be located in the correct axial position during the following steps 2 and 3 and the resulting flanged shaft will not be manufactured properly and will have to be scrapped.

A second resulting disadvantage is that the raw forgings must be supplied within specific critical tolerances. If not, because the traditional method is referenced from the unfinished surface of the raw forging, the resulting flanged shaft will be defective as previously explained.

Another disadvantage of the traditional method is that flanged shafts cannot be manufactured within certain tolerances. Even when the raw forgings 1 are supplied within the normal tolerances traditionally requested, there will always be inherent variations resulting from the forging process. Because the initial milling and center drilling operations are referenced from a surface of the forging in its raw state, these variations will result in variations of a similar magnitude in the finished flanged shafts.

Another problem with the traditional method is that the operations are interdependent. More specifically, because the first step of milling and center drilling establishes the reference points used in the following operations while also milling the shaft end 4, the subsequent steps will result in a defective flanged shaft if the milling and center drilling is not done properly.

SUMMARY OF THE INVENTION

This invention relates to an improved method for manufacturing a flanged shaft from a forging having a shaft and a flange having an inboard side and an outboard side. The improved method of this invention comprises chucking the forging in a first lathe such that at least the outboard side of the forging may be worked on. At least the outboard side of the flange is then finished. The forging is then removed from the first lathe and chucked in a second lathe while referencing the forging off the outboard side of the flange such that the remainder of the forging can be worked on. The remainder of the forging is then finished into a flanged shaft. Alternatively, a single lathe may be used to perform the functions of both the first and second lathes if the single lathe is reconfigured between steps to perform the functions of the first lathe and second lathe.

The improved method of this invention provides a number of advantages. This invention reduces the number of steps traditionally required, reduces the number of machines and workers required, decreases the amount of scrap resulting from manufacturing flanged shafts, allows flanged shafts to be manufactured from forgings outside the traditionally required tolerances, allows flanged shafts to be manufactured to closer tolerances than are traditionally attained, and reduces the interdependency between the steps of the method in producing a flanged shaft within the tolerances required.

These advantages, and other advantages, will be readily appreciated by one of ordinary skill in the art from the following detailed description of the best mode for carrying out the invention in conjunction with the accompanying drawings.

BEST MODE FOR CARRYING OUT THE INVENTION

Figure 1:
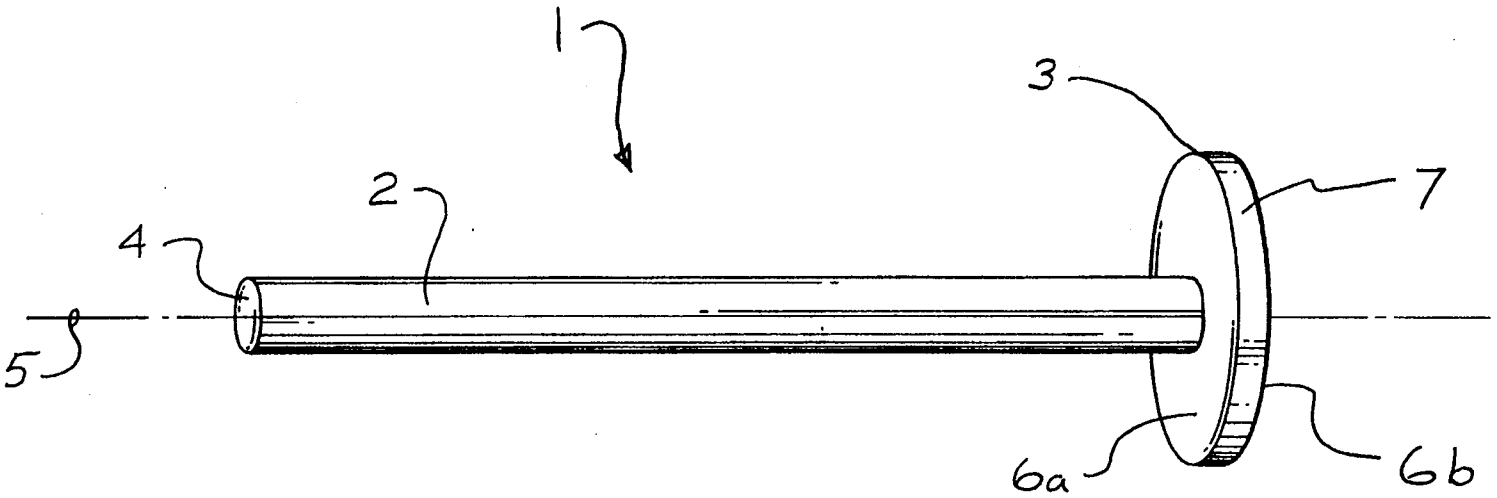
FIG. 1 is a perspective view of a raw forging.
Figure 2:
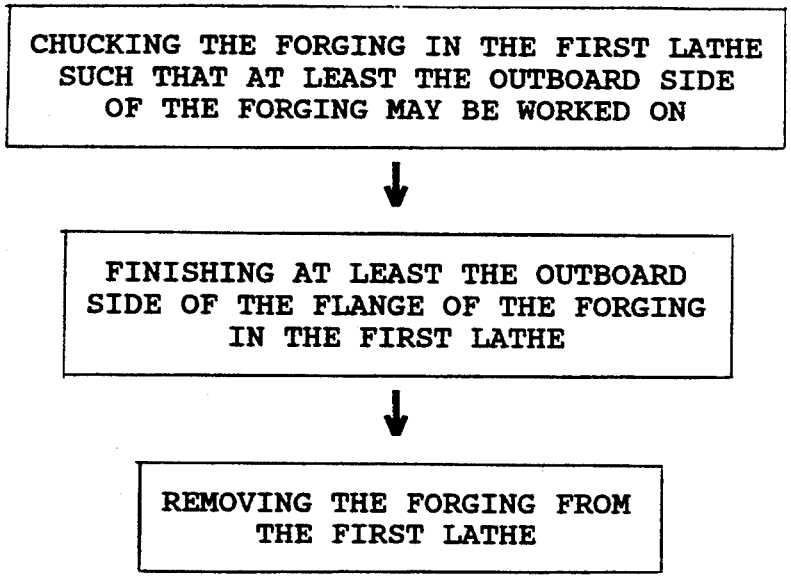
FIG. 2 is a block diagram showing the first step of the method of this invention.
Figure 3:
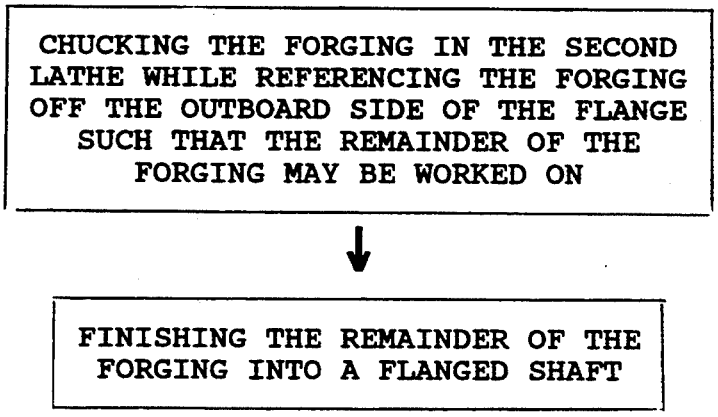
FIG. 3 is a block diagram showing the second step of the method of this invention.

Referring to FIGS. 1, 2 and 3, the two-step method of this invention is preferably carried out in the following manner.

Figure 6:
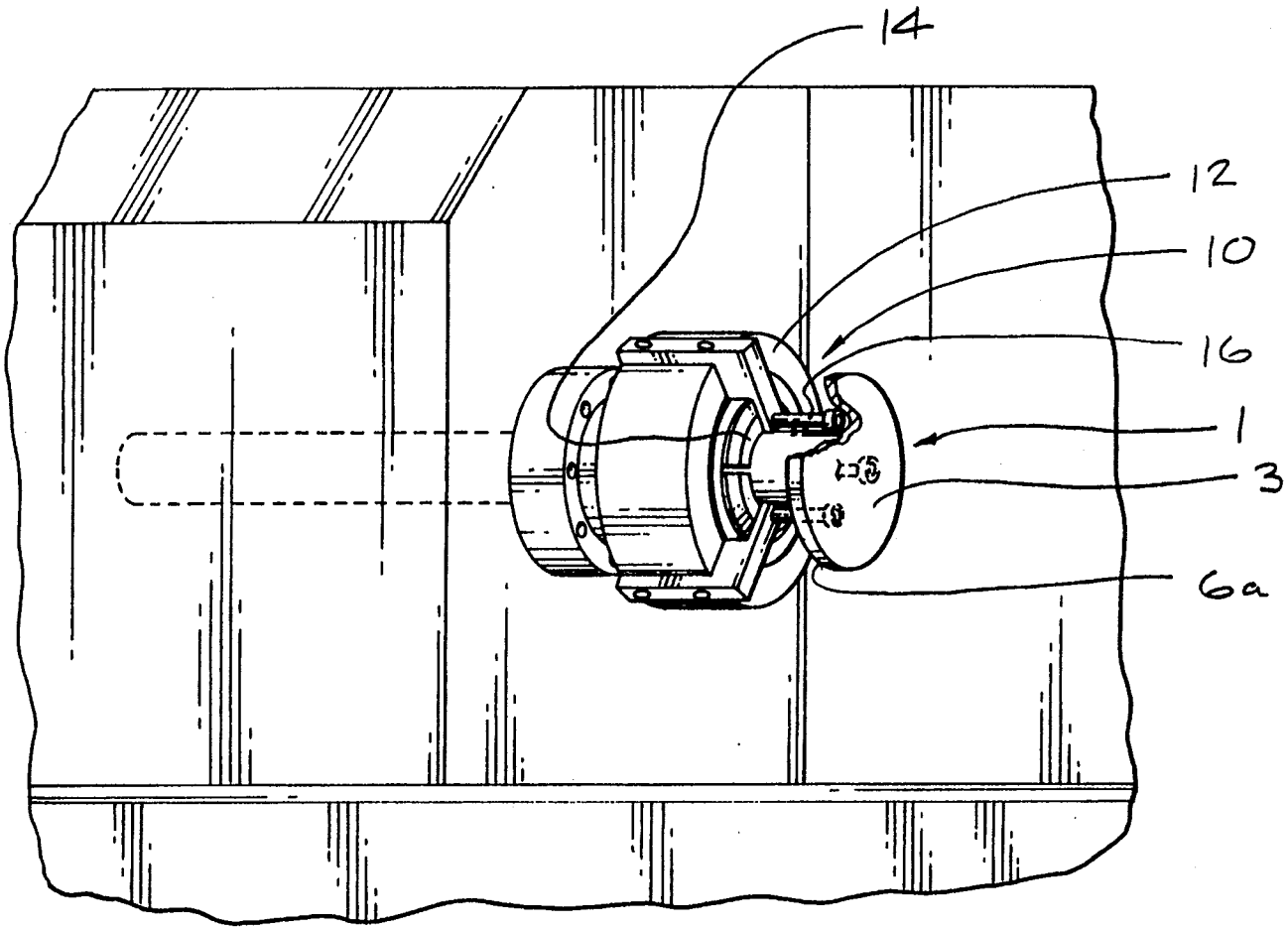
FIG. 6 is a perspective view of a chuck stop which may be used in the method or alternative method of the present invention.

First, as shown in FIG. 2, the forging 1 is chucked in a first lathe such that the outboard side **6*b* of the forging 1 may be worked on. In a preferred embodiment shown in FIG. 6, the shaft 2 of the forging 1 is loaded into the chuck, such as a 3-jaw or 4-jaw chuck, of a first lathe until the inboard side 6*a* of the flange 3 butts against a first chuck stop. The chuck is then locked onto the shaft 2 of the forging 1. While such chuck stops are generally known in the art, FIG. 6 shows one possible arrangement. As shown in FIG. 6, the first chuck stop 10 may comprise a collar 12 around the chuck 14. Three shoulder bolt screws 16 extend from the collar 12. It is these shoulder bolt screws 16 which butt against the inboard side 6*a* of the flange 3 and locate the forging 1** approximately during the first step.

After loading the forging, the first lathe is operated to finish turn the outboard side **6*b* of the flange 3. Preferably, the perimeter 7 of the flange 3 is also finished at this time. The outboard side 6*b*** may also be center drilled at this time if desired.

The forging 1 is then removed from the first lathe. This is normally done by releasing the shaft 2 from the first chuck.

Thus, the outboard side **6*b* is finished independent from any deviations in the surface configuration of the raw forging 1. The first chuck stop in the method of this invention is not used as a reference point but is merely used to approximately position the forging 1** axially. The finished outboard side is then used as the precise reference point in performing the second step.

In the second step, as shown in FIG. 3, the forging 1 is chucked in a second lathe while referencing the forging 1 axially off the outboard side **6*b* of the flange such that the remainder of the forging may be worked on. This may be done by turning the forging 1 end for end and loading the flange 3 into the second chuck, such as a 3-jaw or 4-jaw chuck, of a second lathe. In positioning the forging 1 axially, the finished outboard side 6*b* of the flange 3 is used as a reference by butting the outboard side 6*b*** against a second chuck stop.

In this second step, the forging 1 may be oriented radially by chucking onto the perimeter 7 of the flange 3. If the perimeter 7 of the flange 3 was finished during the first step, all remaining radial finishing work will therefore be referenced from the finished surface of the perimeter 7.

Depending on the length of the shaft 2 it may also be desirable during this second step to support the shaft 2 with a steady rest. Because such steady rests are generally known in the art, they will not be described further here.

As shown in FIG. 3, the remainder of the forging 1 can then be finished into a flanged shaft. Preferably, once the flange 3 is loaded into the second chuck, the second cutting tool of the second lathe will face off the shaft end 4 of the shaft 2. Thus, the length of the resulting flanged shaft is based on a finished side of the flange, unlike the traditional method which mills the forging to the length referenced off an unfinished side of the flange.

If desired, the shaft end 4 can then be center drilled. If the shaft end 4 is center drilled, a center would then come in to support the shaft end 4. The forging would then be turned and a cutting tool used to finish the remainder of the forging into the flanged shaft. Upon completion, the centers, if any, and the second chuck would be released and the resulting flanged shaft can be transferred to other finishing and heat treatment operations if desired.

Note that center drilling the outboard side **6*b* of the flange 3 and the shaft end 4 of the shaft 2** is not required. However, if closer tolerances are needed, center drilling and centering the forging on the second lathe may be desirable prior to turning.

Figure 4:
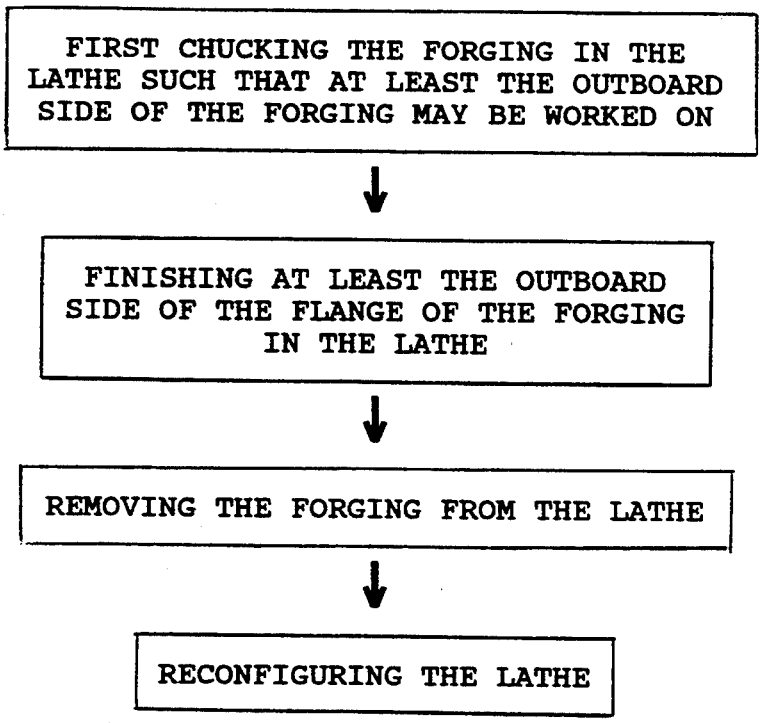
FIG. 4 is a block diagram showing the first step of an alternative method of this invention.
Figure 5:
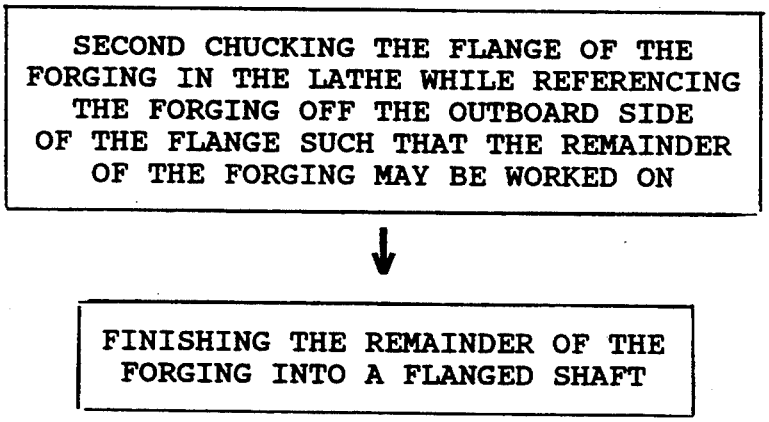
FIG. 5 is a block diagram showing the second step of an alternative method of this invention.

As shown in FIGS. 4 and 5, the steps performed by the first and second lathes can be performed by a single lathe. However, as shown in FIG. 4, this requires the additional effort of reconfiguring the single lathe after the first step before it can be used to perform the second step. Therefore, it is normally preferable to use a second lathe in order to expedite the manufacturing process.

The method of this invention reduces the number of steps required in manufacturing a flanged shaft from three to two. As a result, the number of machines and workers required is less. In fact, using the method of the present invention, a center drill and milling machine is not even required. Accordingly, much less manufacturing floor space is used up by this method. Additionally, because such center drill and milling machines can cost between $100,000 and $1 million, this method also represents a significant dollar savings. Regarding the number of workers required, the method of the present invention can be performed by one worker using two lathe machines back-to-back to perform steps one and two. The first lathe can be in operation while the operator is loading the forging into the second lathe and vice versa. The reduction of the number of steps makes the method of this invention much faster from shaft to finish. As a result, manufacturing inventory levels can be reduced.

Because the finished outboard side 6b of the flange 3 is used as a reference in manufacturing flanged shafts according to the method of this invention, scrap can be almost eliminated. For example, if the flange 3 of the raw forging 1 is not perpendicular to the center axis 5, or if the flange 3 is thicker than it should be, it does not matter. The outboard side 6b of the flange will be finished perpendicular to the axis 5 of the forging 1. The inboard side 6a of the flange 3 is finished during the second step by using the finished outboard side 6b of the flange 3 as a reference. Therefore, even if the flange is too thick at that point, it will be finished to the proper thickness perpendicular to the axis 5 of the forging 1. Furthermore, the shaft end 4 of the shaft 2 is faced off during the second step using the finished outboard side 6b of the flange 3 as a reference, instead of milling the shaft end 4 using the unfinished flange 3 as a reference according to the traditional method. As a result, the overall length of the finished flanged shaft will be correct when using the method of this invention. While it is normal in the industry to expect 5% to 20% scrap resulting from the traditional method, the improved method of this invention has been found to cut scrap down to 0.25%.

The method of this invention also allows the flanged shafts to be manufactured from forgings which do not have to be supplied within the tolerances traditionally required. Because the manufacturing method of this invention is referenced off the finished outboard side 6b of the flange 3, surface variations or geometrical deviations do not affect the dimensions of the finished flanged shaft, unlike the traditional method. Therefore, forging houses or companies which supply forgings do not have to comply with the close tolerances traditionally required. Accordingly, the forgings used will be cheaper to produce, which in turn reduces the total end cost of the finished flanged shafts.

Because surface variations and geometrical deviations do not affect the reference point used in the method of this invention, flanged shafts can be manufactured to much closer tolerances than are traditionally attained. In fact, it has been found that is it possible to manufacture flanged shafts to 1/10th of the tolerances previously attained. Also, by facing off the shaft end 4, instead of milling the shaft end 4, the shaft end 4 has a much higher quality surface finish. Furthermore, bowing and radial deviations are reduced significantly because the shaft 2 immediately adjacent the flange 3 is supported during the first step when the outboard side 6b is being finished and the shaft 2 can be supported by a steady rest during the second step. As a result, straightening of the flanged shaft following any subsequent heat treatments is minimized.

The method of this invention also reduces the interdependency between the steps used. In the traditional method, if the center drilled bores are not drilled to the right depth, the following steps will result in a flanged shaft having dimensions outside the parameters required. However, in the method of this invention, if the outboard side 6b of the flange 3 is not finished to the correct axial position, it does not matter. As long as the flange 3 is still thick enough, the inboard side 6a of the flange 3, and the shaft end 4, will be finished and faced respectively to the correct dimension by using the finished outboard side 6b of the flange 3 as a reference.

Any suitable equipment can be used to perform the method of this invention. This would include a variety of lathe, chuck and steady rest equipment, whether programmable or not. Because such equipment is generally well known in the art, this equipment will not be described in detail here. However, while computer numeric control (CNC) lathes are not required, the inventor has had positive experiences using Wescino and Daewoo CNC lathes. The inventor has also had good experiences using Precision Harding chucks and Arobotech programmable steady rests.

As is readily apparent, a variety of lathes, chucks, chuck stops, steady rests and center drills could be used, depending upon the work requirement and the particular flanged shaft manufactured. While the best mode for carrying out the invention has been described in detail, those familiar to the art to which this invention relates will recognize various alternatives for practicing the invention as defined by the following claims.

What is claimed is:

1. A method for manufacturing a flanged shaft from a forging having a shaft, a shaft end, and a flange having an inboard side, a perimeter and an outboard side using a first lathe and second lathe, the method comprising:

chucking the forging in the first lathe such that at least the outboard side of the forging may be worked on;

finishing at least the outboard side of the flange of the forging in the first lathe;

removing the forging from the first lathe;

chucking the forging in the second lathe while referencing the forging off the outboard side of the flange such that the remainder of the forging may be worked on; and finishing the remainder of the forging into a flanged shaft.

2. The method defined in claim 1, wherein the step of chucking the forging in the first lathe comprises chucking the shaft of the forging.

3. The method defined in claim 2, which further comprises axially positioning the forging in the first lathe by referencing the forging off the outboard side of the flange before chucking the shaft of the forging in the first lathe.

4. The method defined in claim 2, which further comprises chuck stopping the forging off the outboard side of the flange before chucking the shaft of the forging in the first lathe.

5. The method defined in claim 1, wherein the step of finishing at least the outboard side of the flange includes finishing the perimeter of the flange.

6. The method defined in claim 5, wherein the step of chucking the forging in the second lathe includes referencing the forging radially by chucking onto the perimeter of the flange.

7. The method defined in claim 6, wherein the step of chucking the flange of the forging in the second lathe includes referencing the forging axially by chuck stopping the forging off the outboard side of the flange.

8. The method defined in claim 1, wherein the step of finishing the remainder of the forging into a flanged shaft includes facing off the shaft end of the forging.

9. The method defined in claim 1, which further comprises furnishing a steady rest to support the shaft of the forging before finishing the remainder of the forging into a flanged shaft.

10. The method defined in claim 1, which further comprises center drilling the outboard side of the flange after chucking the shaft of the forging in the first lathe and center drilling the shaft end after chucking the flange of the forging in the second lathe and centering the forging between centers before finishing the remainder of the forging into a flanged shaft.

11. The method defined in claim 1, which further comprises axially positioning the forging in the first lathe by referencing the forging off the outboard side of the flange before chucking the forging in the first lathe.

12. The method defined in claim 1, which further comprises chuck stopping the forging off the outboard side of the flange before chucking the forging in the first lathe.

13. The method defined in claim 1, wherein the step of chucking the forging in the second lathe includes referencing the forging axially by chuck stopping the forging off the outboard side of the flange.

14. A method for manufacturing a flanged shaft from a forging having a shaft, a shaft end, and a flange having an inboard side, a perimeter and an outboard side, using a lathe, the method comprising:

first chucking the forging in the lathe such that at least the outboard side of the forging may be worked on;

finishing at least the outboard side of the flange of the forging in the lathe;

removing the forging from the lathe;

reconfiguring the lathe;

second chucking the flange of the forging in the lathe while referencing the forging off the outboard side of the flange such that the remainder of the forging may be worked on; and finishing the remainder of the forging into a flanged shaft.

15. The method defined in claim 14, wherein the step of first chucking the forging comprises first chucking the shaft of the forging.

16. The method defined in claim 15, which further comprises axially positioning the forging in the lathe by referencing the forging off the outboard side of the flange before first chucking the shaft of the forging in the lathe.

17. The method defined in claim 15, which further comprises chuck stopping the forging off the outboard side of the flange before first chucking the shaft of the forging in the lathe.

18. The method defined in claim 14, wherein the step of finishing at least the outboard side of the flange includes finishing the perimeter of the flange.

19. The method defined in claim 18, wherein the step of second chucking the flange of the forging in the lathe includes referencing the forging radially by chucking onto the perimeter of the flange.

20. The method defined in claim 19, wherein the step of second chucking the flange of the forging in the lathe includes referencing the forging by chuck stopping the forging off the outboard side of the flange.

21. The method defined in claim 14, wherein the step of finishing the remainder of the forging into a flanged shaft includes facing off the shaft end of the forging.

22. The method defined in claim 14, which further comprises furnishing a steady rest to support the shaft of the forging before finishing the remainder of the forging into a flanged shaft.

23. The method defined in claim 14, which further comprises center drilling the outboard side of the flange after first chucking the shaft of the forging in the lathe and center drilling the shaft end after second chucking the flange of the forging in the lathe and centering the forging between centers before finishing the remainder of the forging into a flanged shaft.

24. The method defined in claim 14, which further comprises axially positioning the forging in the lathe by referencing the forging off the outboard side of the flange before first chucking the forging in the lathe.

25. The method defined in claim 14, which further comprises chuck stopping the forging off the outboard side of the flange before first chucking the forging in the lathe.

26. The method defined in claim 14, wherein the step of second chucking the forging in the lathe includes referencing the forging by chuck stopping the forging off the outboard side of the flange.

27. A method for manufacturing a flanged shaft from a forging having a shaft, a shaft end, and a flange having an inboard side, a perimeter and an outboard side, using a first lathe having a first chuck and a first cutting tool and a second lathe having a second chuck and a second cutting tool, the method comprising:

chucking the shaft of the forging in the first chuck of the first lathe;

finishing at least the outboard side of the flange of the forging with the first cutting tool of the first lathe;

removing the forging from the first chuck of the first lathe;

chucking the flange of the forging in the second chuck of the second lathe while referencing the forging off the outboard side of the flange;

facing off the shaft end of the forging; and finishing the remainder of the forging into a flanged shaft by using the second cutting tool of the second lathe.

28. The method defined in claim 27, which further comprises axially positioning the forging in the first lathe by referencing the forging off the outboard side of the flange before chucking the shaft of the forging in the first chuck of the first lathe.

29. The method defined in claim 27, wherein the step of finishing at least the outboard side of the flange includes finishing the perimeter of the flange.

30. The method defined in claim 29, wherein the step of chucking the flange of the forging in the second chuck of the second lathe includes referencing the forging radially by chucking onto the perimeter of the flange.

31. The method defined in claim 27, which further comprises chuck stopping the forging off the outboard side of the flange before chucking the shaft of the forging in the first chuck of the first lathe.

32. The method defined in claim 27, wherein the step of chucking the flange of the forging in the second lathe includes referencing the forging by chuck stopping the forging off the outboard side of the flange.

33. The method defined in claim 27, which further comprises furnishing a steady rest to support the shaft of the forging before finishing the remainder of the forging into a flanged shaft.

34. The method defined in claim 27, which further comprises center drilling the outboard side of the flange after chucking the shaft of the forging in the first chuck of the first lathe and center drilling the shaft end after chucking the flange of the forging in the second chuck of the second lathe and centering the forging between centers before finishing the remainder of the forging into a flanged shaft.

* * * * *

UNITED STATES PATENT AND TRADEMARK OFFICE

CERTIFICATE OF CORRECTION

PATENT NO. : 5,448,820

DATED : September 12, 1995

INVENTOR(S) : Timothy A. LeBlanc

It is certified that error appears in the above-identified patent and that said Letters Patent is hereby corrected as shown below:

Column 5, Line 26
, after "flange" insert --3--.

Signed and Sealed this

Fifth Day of March, 1996

Bruce Lehman

*Attest:*

BRUCE LEHMAN

*Attesting Officer*

*Commissioner of Patents and Trademarks*